United States Patent [19]

Kawamura

[11] Patent Number: 4,493,298

[45] Date of Patent: Jan. 15, 1985

[54] GLOW PLUG QUICK HEATING CONTROL DEVICE

[75] Inventor: Hideo Kawamura, Tokyo, Japan

[73] Assignee: Izuzo Motors, Ltd., Tokyo, Japan

[21] Appl. No.: 391,035

[22] Filed: Jun. 22, 1982

[30] Foreign Application Priority Data

Jun. 30, 1981 [JP] Japan ..... 56-102068
Aug. 10, 1981 [JP] Japan ..... 56-117646[U]

[51] Int. Cl.[3] ..... F02B 9/08; F02P 19/00

[52] U.S. Cl. ..... 123/145 A; 219/492; 219/497; 219/508

[58] Field of Search ..... 123/145 A, 179 H; 219/492, 497, 508, 509, 510

[56] References Cited

U.S. PATENT DOCUMENTS 1,948,974 2/1934 Talmey ..... 123/145 A
2,606,544 8/1952 Church ..... 123/145 A
2,840,067 6/1958 Carlson ..... 123/145 A
4,196,712 4/1980 Kawamura ..... 123/179 H
4,211,204 7/1980 Glauner .
4,285,307 8/1981 Steinke ..... 123/145 A
4,375,205 3/1983 Green ..... 123/145 A
4,399,781 8/1983 Tsukasaki ..... 123/145 A

*Primary Examiner*—Donald B. Cox
*Attorney, Agent, or Firm*—Sughrue, Mion, Zinn, Macpeak & Seas

[57] ABSTRACT

A glow plug heating control device for a diesel engine includes a detector for detecting the heat variable resistance of the glow plug, and a device effecting insertion of a resistor in series with the glow plug and the power source at a given point so as to vary the manner of current application to and the heating of the plug in an advantageous non-linear manner.

9 Claims, 7 Drawing Figures

GLOW PLUG QUICK HEATING CONTROL DEVICE

BACKGROUND OF THE INVENTION

This invention relates to a control device for a glow plug which assists in the starting of a diesel engine.

A similar glow plug control device is disclosed in the U.S. Patent Application, Ser. No. 447,370, filed by the present inventor and others on Dec. 6, 1982.

It is well known in the art that it is necessary to heat the combustion chamber of a diesel engine in order to improve the starting characteristics of the engine, and glow plugs are used to so heat the combustion chamber.

Heretofore, it has taken about five to seven seconds to preheat the combustion chamber to a preset preheating temperature (about 900° C.). However, it is rather difficult for an operator who has been familiar with gasoline engines to have to wait the preheating time, e.g. five to seven seconds, in starting the diesel engine. Accordingly, it is desirable to reduce the preheating time. This requirement may be satisfied by increasing the heating speed. However, in this case, the glow plug is quickly heated from a low temperature (about room temperature) to a high temperature (about 900° C.). As a result, the temperature of the heat generating coil of the glow plug is greatly raised while the peripheral portion of the glow plug remains at low temperature. In order words, there is caused a large thermal gradient between the heat generating coil and the peripheral portion, with the result that thermal stress occurs in the glow plug. Accordingly, the heat generating element may be cracked or broken.

After the temperature of the glow plug has reached its predetermined value (900° C. for instance), the voltage is lowered by a resistor provided between the glow plug and the power source, so that the large current to the glow plug is decreased and the glow plug is prevented from being melted.

Heretofore, this voltage dropping or lowering resistor has been a fixed resistor. However, the use of the fixed resistor suffers from the difficulty that since the temperature of the glow plug decreases after the interruption of the large current, it is difficult to make the glow plug sufficiently red hot, i.e., the starting characteristics of the engine are degraded.

SUMMARY OF THE INVENTION

Accordingly, an object of this invention is to provide a glow plug heating control device in which the preheating time is reduced as much as possible, and in which the cracking or breaking of the glow plug, which is due to the thermal stress caused by rapidly heating the glow plug for a short period of time, is prevented.

A further object of the present invention is to provide a temperature controlling resistor for a glow plug, with which, after a large current to the glow plug is interrupted, the temperature of the glow plug is raised to a value slightly higher than a predetermined value and is then decreased gradually, whereby the starting characteristics of the diesel engine are improved.

BRIEF DESCRIPTION OF THE DRAWINGS

One embodiment of this invention will be described with reference to the accompanying detailed drawings, in which.

DETAILED DESCRIPTION OF THE PREFERRED EMBODIMENTS

Figure 1:
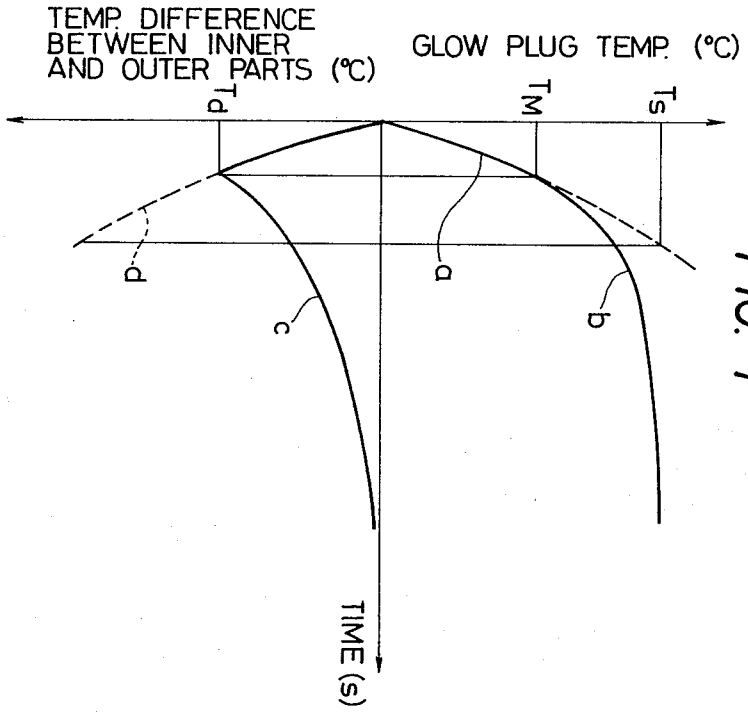
FIG. 1 is a graphical representation indicating glow plug temperature with the heating time, and the temperature difference between inner and outer parts thereof with the heating time, with a glow plug control device according to this invention.
Figure 2:
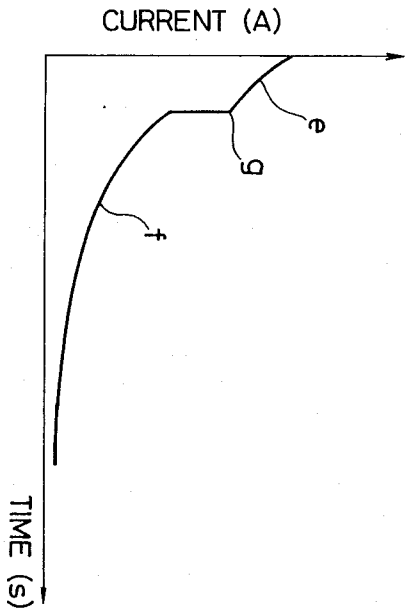
FIG. 2 is a graphical representation indicating the current in the glow plug with the heating time.

The difficulty causing the heat generating element of the glow plug to be cracked or broken is the large difference in temperature between the heat generating element and the peripheral portions of the glow plug, as described above. In order to otain a control device for the glow plug, which eliminates the above-described difficulty and which makes the preheating time of the glow plug very short, two conflicting conditions must be satisfied, i.e. the difference in temperature between the heat generating element and the peripheral portions of the glow plug should be reduced as much as possible, and the preheating time should be reduced. For this purpose, the invention does not employ a method in which, after the preheating of the glow plug is started, the temperature of the glow plug is raised linearly to a predetermined preheating value $T_S$ shown in FIG. 1 at the same heating rate. Instead, the invention employs a method in which the glow plug is heated at an ultra high heating speed (as indicated by the curve a in FIG. 1) until the temperature of the glow plug reaches a value $T_M$, which is selected to be lower than the predetermined preheating value $T_S$. After the temperature of the glow plug reaches the value $T_M$, the ultra high heating speed (as indicated by the curve a) is switched over to a quick (but relatively slower) heating speed (as indicated by the curve b in FIG. 1), corresponding to the heating of the heat generating coil. That is, as shown in FIG. 2, heating is effected with a large initial current e for the time interval from the preheating starting time instant until the heating speed switching time instant (when the temperature reaches the value $T_M$ in FIG. 1), and from the switching time instant g the heating current is decreased in inverse proportion to the preheating time as indicated by the curve f in FIG. 2. The difference in temperature between the heat generating coil part (or the inner part) and the peripheral part (or the outer part) of the plug when using the above-described preheating method, as indicated by the curve c in FIG. 1, is smaller than that in the case of the aforementioned conventional method, as indicated by the curve d in FIG. 1, in which a glow plug is quickly heated linearly to the predetermined preheating temperature after the preheating of the glow plug begins.

Figure 3:
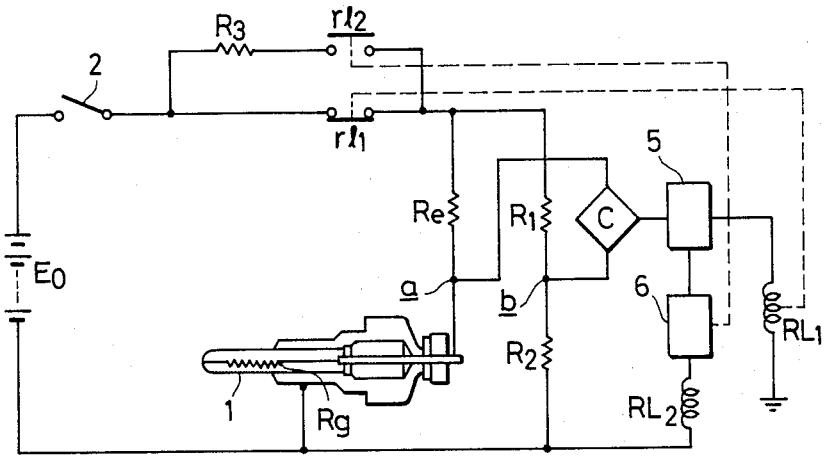
FIG. 3 is a circuit diagram of the glow plug control device according to the invention.

FIG. 3 is a circuit diagram of a control device for a glow plug according to the invention.

In FIG. 3, reference character $E_O$ designates a power source which is the battery for the vehicle; 2, a key switch; 1, a glow plug; Rg, the resistance of the heat generating coil of the glow plug; Re, a glow plug current detecting resistor whose resistance is not more than 1/10 of the resistance of the glow plug at room temperature, the current detecting resistor being connected in series to the heat generating coil of the glow plug; $rl_1$, the normally closed contact means of a first relay; and $rl_2$, the normally open contact means of a second relay. First terminals of the contact means $rl_1$ and $rl_2$ are connected to the current detecting resistor Re. The remaining terminal of the contact means $rl_1$ is connected through the key switch 2 to the power source $E_O$. The remaining terminal of the contact means $rl_2$ is connected through a voltage dropping resistor $R_3$ to the connecting point between the key switch 2 and the contact means $rl_1$. The voltage dropping resistor $R_3$ is made up of a heat generating element, the resistance temperature coefficient of which is equal to that of the heat generating coil of the glow plug. Heating current is applied to the heat generating coil of the glow plug through a heating circuit including the power source $E_O$, the key switch 2, the relay contact means $rl_1$ or the voltage dropping resistor $R_3$ and the relay contact means $rl_2$, and the glow plug 1.

Further in FIG. 3, reference characters $R_1$ and $R_2$ designate resistors which form a bridge circuit with the current detecting resistor Re and the resistance Rg of the glow plug; c, a comparator connected between terminals a and b of the bridge circuit; 5, a relay drive circuit connected to the output terminal of the comparator c; $RL_1$, a first relay coil having one terminal connected to the output terminal of the relay drive circuit 5 and the other terminal grounded; 6, a timer connected to the relay drive circuit 5; $RL_2$, a second relay coil having one terminal connected to the output terminal of the timer and the other terminal connected to the power source $E_O$.

The operation of the control circuit thus organized will now be described.

When the key switch 2 is closed, heating current flows from the power source $E_O$ through the normally closed contact means $rl_1$ of the first relay and the current detecting resistor Re to the glow plug 1; that is, the ultra-high-speed heating operation is carried out. As the glow plug is heated, the resistance Rg of the heat generating coil is gradually increased, and the voltage at the terminal a of the bridge circuit is increased. As the voltage at the terminal a is increased as described above, the equilibrium of the bridge circuit is destroyed, and the voltage across the terminals a and b of the bridge circuit is gradually increased. When the temperature of the glow plug reaches the set value $T_M$ at the switching point g described above, the comparator c starts to provide an output signal. The output signal operates the relay drive circuit 5, so that the relay coil $RL_1$ is energized. Upon energization of the relay coil $RL_1$, the first relay is operated to open its normally closed contact means $rl_1$. The output signal of the relay drive circuit 5 is applied to the timer 6, whereby the relay coil $RL_2$ is energized for a predetermined period of time. Upon energization of the relay coil $RL_2$, the second relay is operated to close its normally open contact means $rl_2$. As a result, the voltage dropping resistor $R_3$ is connected in series with the heat generating coil of the glow plug through the contact means $rl_2$, so that the current flowing in the glow plug is decreased. The voltage dripping resistor $R_3$, as described before, is made up of a heat generating element whose resistance temperature coefficient is equal to that of the heat generating coil of the glow plug, and is installed on the cylinder block of the engine, and accordingly the temperature variation of the voltage dropping resistor is substantially similar to that of the glow plug. Therefore, as the temperature rises, the resistance of the voltage dropping resistor is increased, to thereby decrease the current flowing in the glow plug 1.

Figure 4:
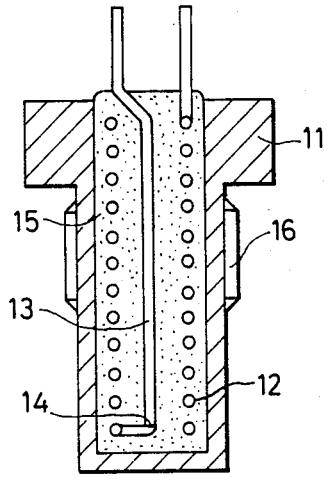
FIG. 4 is a sectional view of a voltage dropping resistor employed in the glow plug control device of the invention.

FIG. 4 is a sectional view showing the structure of the voltage dropping resistor $R_3$. In the body 11 of the resistor $R_3$, a "Nichrome" wire 12 and a nickel wire 13 are coiled, and are connected as indicated at 14, thus forming the aforementioned heat generating element. Heat insulating material 15 is filled in a space defined by the heat generating element consisting of the "Nichrome" wire 12 and the nickel wire 13 and the body 11. The voltage dropping resistor $R_3$ thus constructed is screwed into the engine cylinder block with the aid of its mounting screw 16, so that the temperature of the resistor changes with the temperature of the cylinder block, and accordingly the resistance of the heat generating element.

Figure 5:
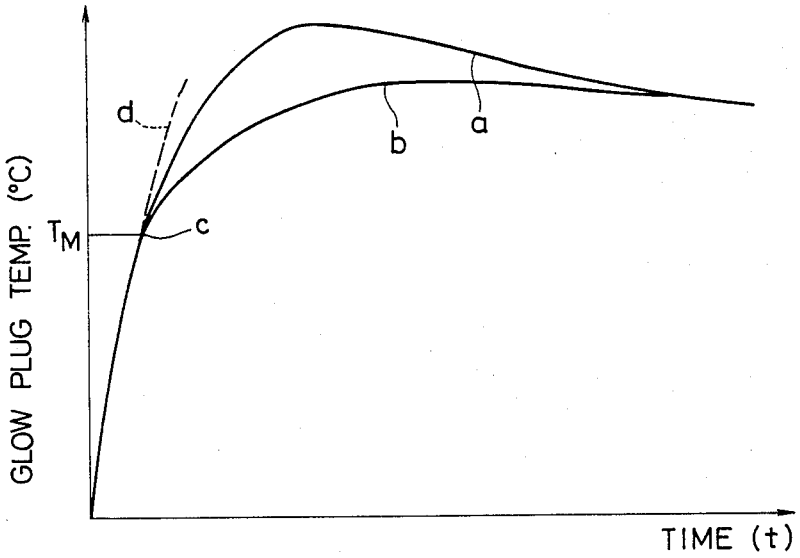
FIG. 5 is a graphical representation indicating the temperature characteristic of a glow plug with the temperature levels of the voltage dropping resistor.

FIG. 5 is a graphical representation indicating the temperature characteristics of the glow plug with respect to the temperature levels of the voltage dropping resistor installed on the engine cylinder block as shown in FIG. 4, when the voltage dropping resistor is connected in series with the glow plug at the switching temperature $T_M$. In FIG. 5, the point c represents the switching temperature $T_M$, the curve a is for the case where the temperature of the voltage dropping resistor is low, the curve b is for the case where the temperature of the voltage dropping resistor is high, and the curve d is for the case where the ultra-high-speed heating operation is continued.

Figure 6:
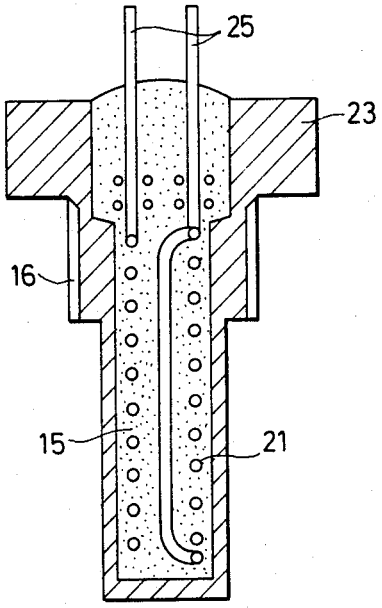
FIG. 6 is a view of an alternatively constructed voltage lowering resistor; and, FIG. 7 is a graphical representation indicating the resistance/temperature characteristics of various resistor wires.

FIG. 6 illustrates a slightly different resistor construction wherein reference numeral 21 designates a coil made up of resistance wires different in resistance temperature coefficient; 15, insulating material; 23, a body; 16, a mounting thread which is cut on the body to mount the device, namely, the glow plug temperature controlling resistor, on a cylinder head or the like; and 25 designates connecting terminals.

The two resistance wires different in resistance temperature coefficient may be a nickel wire and a "Nichrome" wire. The insulating material 15 may be alumina cement or magnesium oxide powder. The body is made of a metal such as aluminium or copper with high thermal conductivity.

Figure 7:
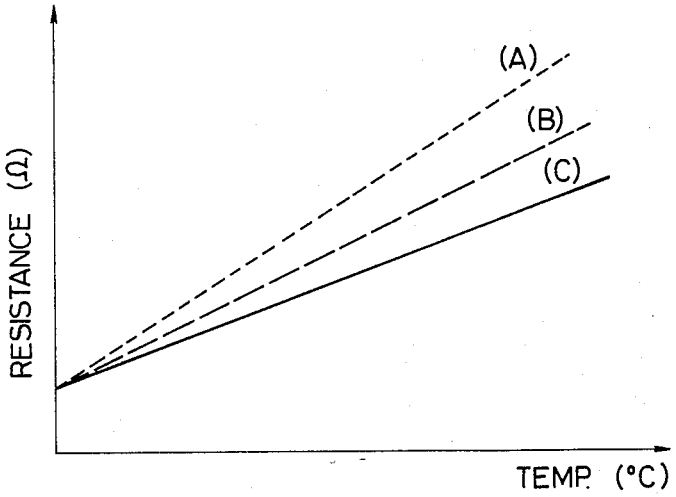

FIG. 7 is a graphical representation indicating the resistance temperature characteristics of a single nickel wire (A), a single "Nichrome" wire (B) and a wire (C) which is obtained by connecting a nickel wire in series with a "Nichrome" wire.

As is apparent from the figures, the employment of the resistor provides the following effect: After the large current to the glow plug is interrupted, the temperature is increased to higher values, and then the temperature may be gradually decreased. Accordingly, the starting characteristics of the diesel engine can be remarkably improved.

As is apparent from the above description, the glow plug control device according to the invention does not employ an engine starting method in which, after the preheating of the glow plug is started, the combustion chamber is heated linearly to the preheating temperature at an ultra-high-speed. Instead the control device employs a method in which, when the temperature of a glow plug reaches a predetermined value which is lower than the preheating temperature, a switching means is operated to connect a voltage dropping resistor in series with the heat generating coil of the glow plug, to thereby decrease the heating rate. Accordingly, the control device of the invention has the following effects or merits: The difficulty where the heat generating element is cracked or broken by thermal stress caused when the temperature of the combustion chamber is linearly raised at an extremely high speed has been eliminated. In the preheating operation according to the invention, unlike the conventional preheating operation, the preheating time is relatively short. Thus, it is unnecessary for the operator to have to wait for an extended preheating time in starting the engine.

What is claimed is:

1. A glow plug heating circuit for use with a glow plug having a heat generating element whose resistance varies with heating temperature comprising; a series connection of said glow plug, a power source, and a current detecting resistor, and switching means for inserting a voltage dropping resistor into said series circuit, so as to vary a current applied to said glow plug in a non-linear manner, wherein said voltage dropping resistor includes a heat generating element the temperature coefficient of which is equal to that of said heat generating element of said glow plug.

2. A control device with a glow plug heating circuit in which a glow plug having a heat generating element whose resistance varies with heating temperature, a current detecting resistor, and a switching unit are connected in series with a power source, comprising:

means for determining the resistance of said heat generating element according to a voltage developed across said current detector resistor;

comparator means for providing an output signal when said determined value reaches a set value correspondingly smaller than a predetermined preheating temperature; and switching unit driving means for operating said switching unit in response to an output of said comparator, to open said glow plug heating circuit and to insert a voltage dropping resistor in series in said heating circuit to complete said heating circuit, wherein said voltage dropping resistor includes a heat generating element, the temperature coefficient of which is equal to that of said heat generating element of said glow plug.

3. A control resistor for use with a glow plug, comprising:

a coil including at least two series connected resistance wires having different resistance/temperature characteristics wherein the resistance of said wires substantially equals the resistance of an element of said glow plug; and an insulating material surrounding said coil.

4. A control device as claimed in claim 2, said voltage dropping resistor being installed on a cylinder block of said engine so that the temperature of said resistor varies in accordance with the temperature variation of said engine block.

5. A control device as claimed in claim 2, said switching unit driving means including relay drive circuit means responsive to said comparator output for operating a first relay to open said heating circuit, and timer means for activating a second relay for a predetermined time to connect said voltage dropping resistor in said heating circuit.

6. A control device as claimed in claim 2, said determining means including a bridge circuit including the resistance of the glow plug and said current detecting resistor.

7. A control device as claimed in claim 2, said voltage dropping resistor including at least two series connected resistance wires having differing resistance/temperature coefficients.

8. A device as claimed in claim 2, said resistor having a temperature coefficient substantially equal to that of an element of said glow plug.

9. A glow plug heating circuit as recited in claim 1, wherein said heat generating element comprises at least two series connected resistance wires having different resistance/temperature coefficients.

* * * * *

UNITED STATES PATENT AND TRADEMARK OFFICE

CERTIFICATE OF CORRECTION

PATENT NO. : 4,493,298

DATED : January 15, 1985

INVENTOR(S) : Hideo Kawamura

It is certified that error appears in the above-identified patent and that said Letters Patent is hereby corrected as shown below:

On page 1, column 1, line beginning "[73] Assignee:", delete "Izuzo" insert --Isuzu--.

Signed and Sealed this

*Seventeenth* Day of *December 1985*

[SEAL]

*Attest:*

DONALD J. QUIGG

*Attesting Officer*

*Commissioner of Patents and Trademarks*